US005354603A

United States Patent [19]

Errede et al.

[11] Patent Number: 5,354,603

[45] Date of Patent: Oct. 11, 1994

[54] ANTIFOULING/ANTICORROSIVE COMPOSITE MARINE STRUCTURE

[75] Inventors: Louis A. Errede, North Oaks, Minn.; Carol E. Hendrickson, Houlton, Wis.; Dale R. Anderson, Mahtomedi, Minn.

[73] Assignee: Minnesota Mining and Manufacturing Company, St. Paul, Minn.

[21] Appl. No.: 4,967

[22] Filed: Jan. 15, 1993

[51] Int. Cl.[5] ..... B32B 5/00

[52] U.S. Cl. ..... 428/240; 428/242; 428/281; 428/283; 428/305.5; 428/311.1; 428/311.5; 428/317.9; 428/323; 428/328; 428/343; 428/352; 422/6

[58] Field of Search ..... 422/6; 428/283, 323, 428/328, 343, 352, 240, 242, 281, 305.5, 311.1, 311.5, 317.9

[56] References Cited

U.S. PATENT DOCUMENTS

| | | | |
|---|---|---|---|
| 3,338,992 | 8/1967 | Kinney | 264/24 |
| 3,407,096 | 10/1968 | Landi | 136/86 |
| 3,497,990 | 3/1970 | Jeffries | 43/131 |
| 3,505,758 | 4/1970 | Willisford | 43/131 |
| 3,509,009 | 4/1970 | Hartmann | 161/150 |
| 3,528,129 | 9/1970 | Hartmann | 18/8 |
| 3,549,591 | 12/1970 | Griffith | 260/47 |
| 3,720,639 | 3/1973 | Griffith | 260/33.4 |
| 3,852,222 | 12/1974 | Field et al. | 260/2 EP |
| 3,872,045 | 3/1975 | Field et al. | 260/31.2 R |
| 3,879,430 | 4/1975 | O'Rear et al. | 260/348 R |
| 3,971,373 | 7/1976 | Braun | 128/146.2 |
| 4,042,402 | 8/1977 | Drake et al. | 106/15 |
| 4,042,747 | 8/1977 | Breton et al. | 428/323 |
| 4,045,408 | 8/1977 | Griffith et al. | 260/47 EA |
| 4,098,955 | 7/1978 | Partridge | 428/537 |
| 4,110,519 | 8/1978 | Nilsson | 429/217 |

(List continued on next page.)

FOREIGN PATENT DOCUMENTS

| | | |
|---|---|---|
| 2050794 | 4/1971 | France . |
| 59-061607 | 4/1984 | Japan . |
| 59-240082A | 11/1984 | Japan . |
| WO92/07899 | 5/1992 | PCT Int'l Appl. . |
| 2040232 | 8/1980 | United Kingdom . |

OTHER PUBLICATIONS

Chapter 14, "Marine Fouling and Its Prevention", United States Naval Institute, Annapolis, Md., 1952, pp. 241–242 and 319–320.

Leon S. Birnbaum, "The Technology of Antifouling Coatings", *The Journal of Protective Coatings & Linings,* (Apr., 1987), pp. 39–46.

K. S. Love and D. E. Field, R. F. Brady, Jr. and J. R. Griffith, "Nontoxic Alternatives to Antifouling Paints", *Journal of Coatings Technology,* vol. 59, No. 755, Dec. 1987, pp. 113–119.

Van A. Wente, "Superfine Thermoplastic Fibers", *Industrial and Engineering Chemistry,* vol. 48, No. 8, pp. 1342–1346, Aug. 1956.

Brian Hogan, "Particulates Captured/Carried by Fibrillated PTFE", *Design News,* pp. 166, 167, Feb. 9, 1987.

*Primary Examiner*—Patrick J. Ryan
*Assistant Examiner*—Marie R. Macholl
*Attorney, Agent, or Firm*—Gary L. Griswold; Walter N. Kirn; Lorraine R. Sherman

[57] ABSTRACT

A composite marine structure comprises a marine substrate having adhered to at least a portion of its surface a layer of a water-permeable composite article comprising a non-woven fibrous web having entrapped therein active particulate to provide said marine substrate with protection against at least one of fouling and corrosion. Underwater surfaces such as ship hulls, buoys, docks, intake pipes, etc., can be protected against marine growth and corrosion by adhering thereto the composite sheet article of the invention.

24 Claims, 2 Drawing Sheets

U.S. PATENT DOCUMENTS

| | | | |
|---|---|---|---|
| 4,118,531 | 10/1978 | Hauser | 428/224 |
| 4,132,681 | 1/1979 | Field et al. | 260/836 |
| 4,153,661 | 5/1979 | Ree et al. | 264/120 |
| 4,157,358 | 6/1979 | Field et al. | 260/836 |
| 4,194,040 | 3/1980 | Breton et al. | 428/308 |
| 4,208,472 | 6/1980 | Cho et al. | 428/550 |
| 4,284,747 | 8/1981 | Griffith et al. | 525/530 |
| 4,332,698 | 6/1982 | Bernstein et al. | 252/430 |
| 4,358,396 | 11/1982 | Bernstein et al. | 252/430 |
| 4,373,519 | 2/1983 | Errede et al. | 128/156 |
| 4,400,434 | 8/1983 | Santoso et al. | 428/421 |
| 4,405,493 | 9/1983 | Pippard | 252/389 A |
| 4,437,271 | 3/1984 | McAvoy | 51/400 |
| 4,452,998 | 6/1984 | Griffith et al. | 560/221 |
| 4,460,642 | 7/1984 | Errede et al. | 428/283 |
| 4,501,793 | 2/1985 | Sarada | 428/315.5 |
| 4,508,775 | 4/1985 | Adiletta | 428/240 |
| 4,530,881 | 7/1985 | Santoso et al. | 428/421 |
| 4,539,256 | 9/1985 | Shipman | 428/315.5 |
| 4,556,618 | 12/1985 | Shia | 429/217 |
| 4,557,957 | 12/1985 | Manniso | 428/36 |
| 4,565,663 | 1/1986 | Errede et al. | 264/120 |
| 4,576,861 | 3/1986 | Kato | 428/316.6 |
| 4,663,023 | 5/1987 | McCandlish et al. | 208/112 |
| 4,720,400 | 1/1988 | Manniso | 427/243 |
| 4,722,898 | 2/1988 | Errede et al. | 435/182 |
| 4,737,560 | 4/1988 | Heilmann et al. | 526/304 |
| 4,810,381 | 3/1989 | Hagen et al. | 210/502.1 |
| 4,814,227 | 3/1989 | Maeda et al. | 428/353 |
| 4,857,381 | 8/1989 | Suzuki | 428/128 |
| 4,862,066 | 8/1989 | Sato et al. | 324/65 P |
| 4,865,909 | 9/1989 | Manniso | 428/251 |
| 4,869,922 | 9/1989 | D'Agostino et al. | 427/38 |
| 4,871,671 | 10/1989 | Errede et al. | 435/182 |
| 4,892,669 | 1/1990 | Marcora et al. | 252/30 |
| 4,893,439 | 1/1990 | McAvoy et al. | 51/400 |
| 4,895,756 | 1/1990 | Suzuki | 428/317.9 |
| 4,906,378 | 3/1990 | Hagen et al. | 210/635 |
| 4,923,894 | 5/1990 | Kanda et al. | 514/493 |
| 4,933,229 | 6/1990 | Insley | 428/224 |
| 4,947,785 | 8/1990 | Milne | 114/357 |
| 4,957,943 | 9/1990 | McAllister et al. | 521/64 |
| 4,971,697 | 11/1990 | Douden et al. | 210/502.1 |
| 4,971,736 | 11/1990 | Hagen et al. | 264/22 |
| 4,985,296 | 1/1991 | Mortimer, Jr. | 428/220 |
| 5,019,232 | 5/1991 | Wilson et al. | 204/182.8 |
| 5,030,496 | 7/1991 | McGurran | 428/85 |
| 5,071,610 | 12/1991 | Hagen et al. | 264/120 |
| 5,082,720 | 1/1992 | Hayes | 428/224 |
| 5,104,632 | 4/1992 | Douden et al. | 423/335 |
| 5,113,860 | 5/1992 | McQuinn | 128/632 |
| 5,116,496 | 5/1992 | Scott | 210/232 |
| 5,117,882 | 6/1992 | Stanford | 114/67 A |
| 5,130,342 | 7/1992 | McAllister et al. | 521/61 |
| 5,147,539 | 9/1992 | Hagen et al. | 210/198.3 |
| 5,226,380 | 7/1993 | Fischer | 114/222 |

ANTIFOULING/ANTICORROSIVE COMPOSITE MARINE STRUCTURE

FIELD OF THE INVENTION

This invention relates to articles which are antifouling/anticorrosive composite structures comprising a marine substrate having adhered to at least a portion of one surface a water-permeable composite article comprising a non-woven, fibrous web with active particulate entrapped therein. In another aspect, a method of preventing corrosion or the accumulation of marine growth, or both, is disclosed. Submerged marine substrates to which the articles are attached are provided with fouling protection, corrosion protection, or both.

BACKGROUND OF THE INVENTION

Objects which are submerged in water, such as ship hulls and anchored structures, are prime targets for undesired marine growth accumulation because many marine organisms require permanent attachment to a solid object. Such accumulation and eventual encrusting can promote corrosion and interfere with the normal workings of submerged structures. To prevent such fouling, antifouling paints containing various biotoxins have been used to coat submerged structures. Biotoxin-loaded paints prevent fouling by interfering with the ability of marine organisms to attach to submerged structures, either by weakening or killing the organism.

Typical antifouling paints contain one or more marine biotoxins contained in a resin. To achieve a lethal concentration of biotoxin at the water-substrate interface, such paints rely on diffusion of biotoxin through the resin to the paint surface. Because the rate of diffusion of biotoxin from the surface into the water is much faster than the rate of diffusion of biotoxin from the bulk resin to the surface, the surface concentration of biotoxin drops below the lethal limit long before all of the biotoxin in the paint is depleted. Both material and time (i.e., that necessary to repaint the substrate) are wasted through this inefficient method.

Recent advances in this area include erodible, or "self-polishing", paints. With such paints, a fresh surface of paint, and thus of biotoxin, is continuously exposed through the slow dissolution or disintegration of the outer layer of paint into the surrounding water. Significant amounts of water-eroded polymer are left to pollute the water body in question, however.

Alternative antifouling materials have been developed. For instance, marine organisms can be removed (e.g., by high pressure sprays) from surfaces treated with release coatings, such as silicones and fluorinated epoxy polymers, more easily than from non-treated surfaces. A similar approach is to bond a sheet containing such a coating to the marine surface through an intermediate barrier layer. A copper-nickel alloy plate with a primer layer and an adhesive is described in U.S. Pat. No. 4,814,227. Another alternative, described in U.S. Pat. No. 4,865,909, is a hydrophobic polymeric membrane, containing numerous pores, which is adhered to the surface to be protected by a biotoxin-containing paint. Here, the paint is still the antifouling agent, but the membrane prevents random leaching of the active agent into the surrounding water. The preferred polymeric substance for this method is polytetrafluoroethylene (PTFE).

Particle-loaded, non-woven, fibrous articles wherein the non-woven fibrous web can be compressed, fused, melt-extruded, air-laid, spunbonded, mechanically pressed, or derived from from phase separation processes have been disclosed as useful in separation science. Sheet products of non-woven webs having dispersed therein sorbent particulate have been disclosed to be useful as, for example, respirators, protective garments, fluid-retaining articles, wipes for oil and/or water, and chromatographic and separation articles. Coated, inorganic oxide particles have also been enmeshed in such webs. Such webs with enmeshed particles which are covalently reactive with ligands (including biologically-active materials) have also been recently developed.

Numerous examples of PTFE filled with or entrapping particulate material are known in many fields. Many applications for PTFE filled with electroconductive materials are known. These include circuit boards, oil leak sensors, electrical insulators, semipermeable membranes, and various types of electrodes. Other such combinations have been used as gasket or sealing materials and wet friction materials. Still others have been used to produce high-strength PTFE films and sheets with applications as structural elements and electronic components. Where the particulate has catalytic properties, this type of combination provides a form which can be conveniently handled. U.S. Pat. No. 4,153,661 discloses various particulate, including cupric oxide, distributed in a matrix of entangled PTFE fibrils as being useful in, among other things, electronic insulators and semipermeable membranes.

Numerous combinations of PTFE and metals in which the metal is not entrapped within a PTFE matrix are also known. These include PTFE membranes completely or partially coated with metal and metal matrices with a network of fibrillated PTFE in the pores thereof. PTFE powder with metal filler has been used (in paste form) as a battery electrode and as a self-lubricating layer coated on bronze bearings. PTFE films coated onto metal films and plates are also known.

Methods of preparing fibrillated PTFE webs have been described in, for example, U.S. Pat. Nos. 4,153,661, 4,460,642, and 5,071,610.

SUMMARY OF INVENTION

Briefly, the present invention provides a composite marine structure comprising a marine substrate having adhered to at least one portion of its surface a layer of a water-permeable composite article comprising:

(a) a non-woven, fibrous web and (b) active particulate entrapped in said web, wherein said composite article provides at least one of fouling protection to said marine structure and corrosion protection to said marine substrate.

In another aspect, the present invention provides at least one of the above-described composite articles for use with a marine substrate wherein the article further comprises on at least one surface thereof a liner strippably adhered thereto.

In yet another aspect, the present invention provides at least one composite article useful with a marine substrate wherein the article comprises (a) a non-woven web, (b) particulate entrapped in said web, which particulate is active toward at least one of fouling and corrosion, and (c) a dual-sided tape attached to at least a portion of one surface of said web, wherein said dual-sided tape can be either a transfer tape or a double-coated tape (i.e., a tape construction with an adhesive on each side of a substrate, which adhesives can be the same or different).

In a further aspect, the present invention provides a method of interfering with at least one of (1) accumulation of marine organism growth on, and (2) corrosion of underwater surfaces, comprising the steps of:

(a) allowing fresh or sea water to come into contact with a composite sheet article which is in intimate contact with a marine substrate, said composite sheet article comprising a porous, non-woven, fibrous web with active particles entrapped therein, and (b) allowing the active particles of the composite marine substrate to interfere with the life cycle of the marine organisms, passivate the marine substrate, or both.

In this application, the following definitions will apply:

"fibers" means fibrils, microfibers, and macrofibers;

"fouling" means the attaching and subsequent encrusting of marine life forms on underwater surfaces;

"antifouling" means capable of reducing or preventing accumulation and growth of undesired marine life forms on underwater surfaces;

"web" means an open-structured, entangled mass of fibers;

"entrapped" means encaged within, adhesively attached to, or encased within the material defining the porous structure;

"macrofibers" means thermoplastic fibers having an average diameter in the general range of 50 μm to 1000 μm. (As used in this application, the term "macrofibers" encompasses textile size fibers as well as what are generally known as macrofibers.);

"microfibers" means thermoplastic fibers having an average diameter of more than zero to 50 μm, preferably of more than zero to 25 μm; and "active" means having chemical or biological activity.

The present invention teaches a conformable, water-permeable composite sheet article attached to a marine substrate. All or nearly all portions of this article which are immersed in a permeating fluid such as water are completely accessible to that permeating fluid. This composite sheet article is comprised of a non-woven, fibrous matrix in which is entrapped, preferably homogeneously, at least one of an antifouling agent and an anticorrosive agent. It may be desirable to provide a water-resistant adhesive on a surface of the sheet article or on an outer surface of the marine substrate to ensure good adherence of the sheet article to the marine substrate when submerged in fresh or sea water. Because the entire thickness of the submerged portion of the sheet article is accessible to water, all reactive particles are available as antifoulant and/or anticorrosive agents to protect that portion of the marine substrate which is submerged. This obviates the need for frequent reapplications of traditional antifoulant and/or anticorrosive coatings due to their loss of efficacy upon depletion of reactants from their surface layers.

The possibility of incorporating in the composite sheet article a plurality of antifouling and anticorrosive particulate is also envisioned within the scope of the present invention. In certain embodiments, it may be advantageous for the composite substrate to comprise strata of different particulate. For example, when the marine substrate is metallic, the particulate layer of the composite sheet article closest to the marine substrate can comprise anticorrosive particulate whereas other layers can comprise antifouling particulate. If the substrate is wooden, the particulate layer closest to the substrate can comprise a wood preservative such as pentachlorophenol or creosote. Other strata of the composite sheet article can contain various other particulate including pigments. Use of a single, multipurpose composite marine structure eliminates the need for application of numerous coats of separate, distinct protectants to a marine substrate and provides the opportunity to customize antifouling agents for particular uses and areas.

The present invention provides marine substrates with fouling protection, corrosion protection, or both, while potential pollutants which provide little or no fouling protection, such as resins and water-erodible polymers, are eliminated.

DETAILED DESCRIPTION OF THE DRAWINGS

Figure 1:
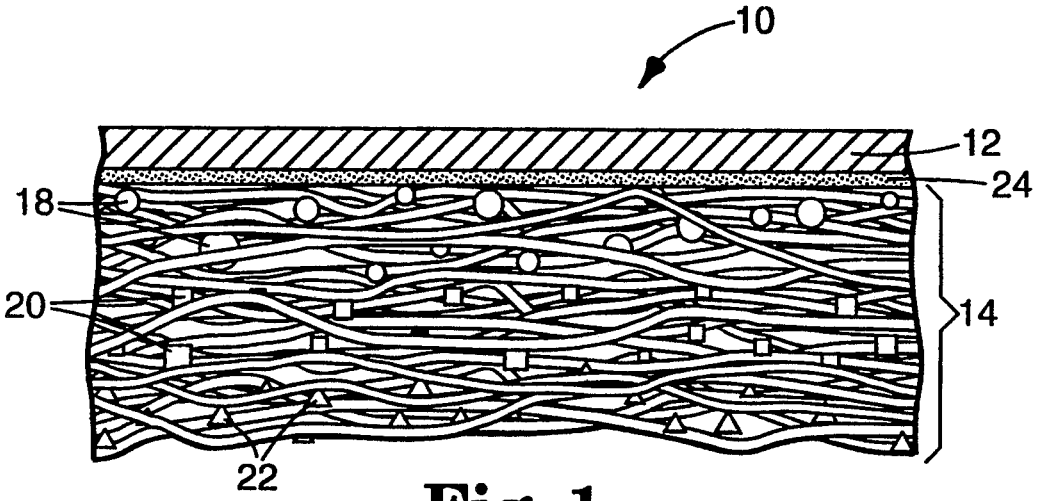
FIG. 1 is a greatly enlarged cross sectional view showing one embodiment of a composite marine structure of the present invention.

FIG. 1 shows composite marine structure 10 having marine substrate 12 and one embodiment of water-permeable composite article 14 which is attached to the marine substrate by means of adhesive layer 24. Composite article 14 has a web of polymeric fibers 16 which entrap and hold a variety of particulate 18, 20, and 22. Particulate are arranged in strata such that particulate having anticorrosive properties 18 is closest to marine substrate 12. Different types of antifouling particulate 20 and 22 are in the layers closest to the article-liquid interface. Adhesive 24 can be pre-applied to composite article 14 or can be applied to substrate 12 before article 14 is to be applied thereto.

Figure 2:
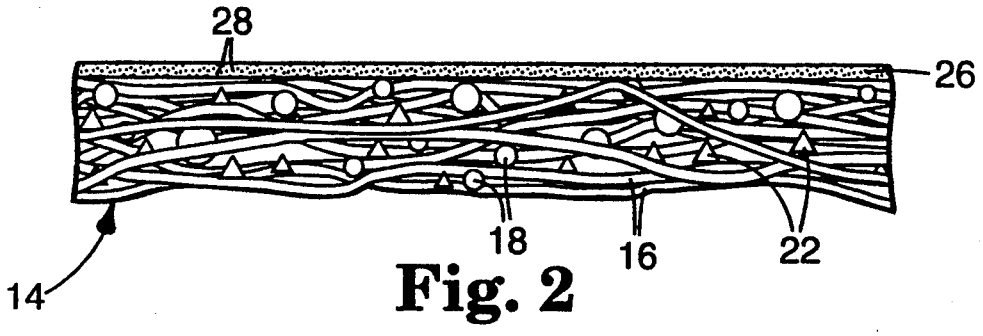
FIG. 2 is a greatly enlarged cross sectional view showing a second embodiment of a composite marine article of the present invention.

FIG. 2 shows a second embodiment of water-permeable composite article 14 including layer of double-coated tape 26. Anticorrosive particulate 18 and antifouling particulate 22 are essentially uniformily distributed throughout and entrapped in a single layer of article 14. Particulate 18 and 22 are held in article 14 by means of polymeric fibers 16. Anticorrosive particulate 28, which can be the same as or different from anticorrosive particulate 18, is included in the adhesive of the tape 26.

Figure 3:
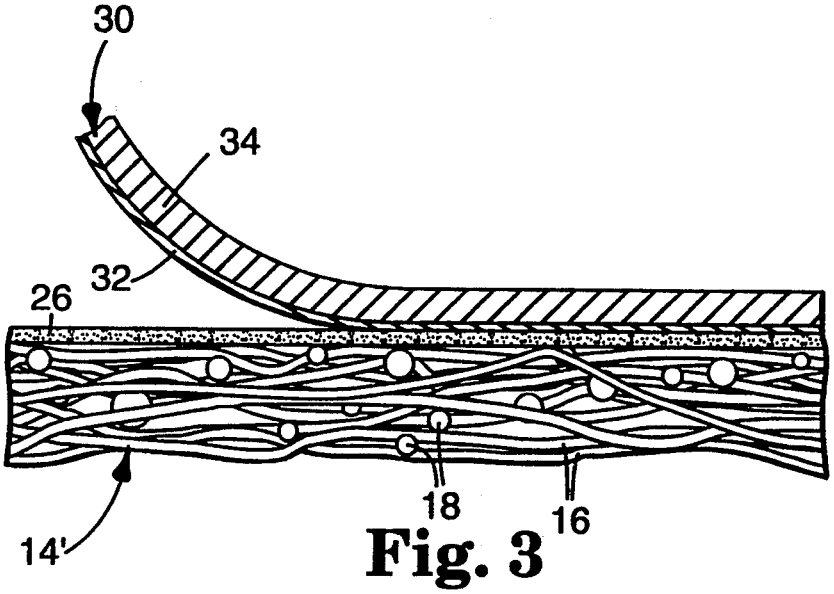
FIG. 3 is a greatly enlarged cross sectional view showing a third embodiment of a composite marine article of the present invention.

FIG. 3 shows a third embodiment of water-permeable composite article 14' including layer of double-coated tape 26 to which has been strippably adhered release liner 30. Release liner 30 comprises release coating 32 and backing 34. Tape 26 preferentially releases from coating 32. Antifouling particulate 18 is homogeneously spread throughout and entrapped in a single layer of article 14' by means of polymeric fibers 16.

Figure 4:
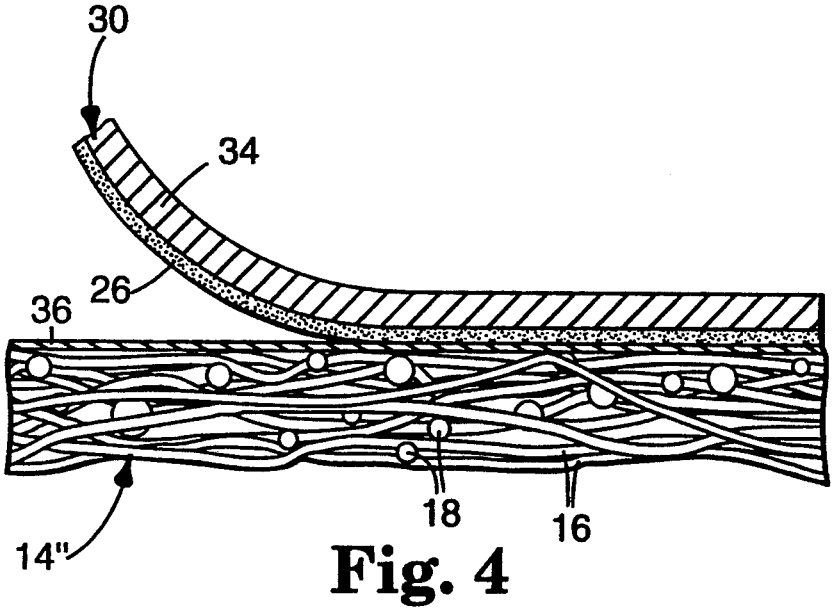
FIG. 4 is a greatly enlarged cross sectional view showing a fourth embodiment of a composite marine article of the present invention.

FIG. 4 shows a fourth embodiment of composite article 14" including release liner 30 and water-soluble release coating 36. Release liner 30 comprises double-coated tape 26 and backing 34. Tape 26 preferentially releases from coating 36 and adheres to backing 34. Coating 36 harmlessly dissolves once article 14" is submerged, thus rendering article 14" water permeable. Antifouling particulate 18 is homogeneously spread throughout and entrapped in a single layer of article 14" by means of polymeric fibers 16.

DETAILED DESCRIPTION OF PREFERRED EMBODIMENTS

Preparation of the composite marine structure of the present invention requires providing a water-permeable composite sheet article comprising a non-woven, fibrous polymeric matrix having active particulate entrapped therein and adhering the same to at least a portion of a marine substrate.

Substrates amenable to use in the present invention include, but are not limited to, wood, plastic, plastic composite (e.g., fiberglass), and metal objects which are or can be submerged in salt or fresh water. Examples include buoys; piers and the pilings thereof; ship, boat, and submarine hulls, rudders, and propellers; anchors; water intake pipes and conduits; and lock gates.

I. Making the Sheet Article

A. PTFE Webs

In one embodiment of the article of the present invention, an aqueous PTFE dispersion is used to produce a fibrillated web. This milky-white dispersion contains about 30% to 70% (by weight) of minute PTFE particles suspended in water. A major portion of these PTFE particles range in size from 0.05 μm to about 0.5 μm. Commercially available aqueous PTFE dispersions may contain other ingredients such as surfactants and stabilizers which promote continued suspension. Examples of such commercially available dispersions include Teflon TM 30, Teflon TM 30B, and Teflon TM 42 (DuPont de Nemours Chemical Corp.; Wilmington, Del.). Teflon TM 30 and Teflon TM 30B contain about 59% to 61% (by weight) PTFE solids and about 5.5% to 6.5% (by weight, based on the weight of PTFE resin) of a non-ionic wetting agent, typically octylphenyl polyoxyethylene or nonylphenyl polyoxyethylene. Teflon TM 42 contains about 32% to 35% (by weight) PTFE solids and no wetting agent (but does contain a surface layer of organic solvent to prevent evaporation).

The composite sheet article comprising fibrillated PTFE preferably is prepared as described in any of U.S. Pat. Nos. 4,153,661, 4,460,642, and 5,071,610, the processes of which are incorporated herein by reference, by blending the desired reactive particulate into the aqueous PTFE emulsion in the presence of sufficient lubricant to exceed the absorptive capacity of the solids yet maintain a putty-like consistency. This putty-like mass is then subjected to intensive mixing at a temperature preferably between 40° and 100° C. to cause initial fibrillation of the PTFE particles. The resulting putty-like mass is then repeatedly and biaxially calendered, with a progressive narrowing of the gap between the rollers (while at least maintaining the water content), until the shear causes the PTFE to fibrillate and enmesh the particulate and a layer of desired thickness is obtained. Removal of any residual surfactant or wetting agent by organic solvent extraction or by washing with water after formation of the sheet article is generally desirable. The resultant sheet is then dried. Such sheets preferably have thicknesses in the range of 0.1 mm to 0.5 mm. Sheet articles with a thickness in the general range of 0.05 mm to 10 mm can be useful.

If a sheet article with multiple particulate layers is desired, the component layers themselves are placed parallel to each other and calendered until they form a composite where the PTFE fibrils of the separate layers are entwined at the interface of adjacent sheets. Multilayer articles preferably have thicknesses in the range of 0.1 mm to 10 mm.

The void size and volume within such a web can be controlled by regulating the lubricant level during fabrication as described in U.S. Pat. No. 5,071,610. Because both the size and the volume of the voids can vary directly with the amount of lubricant present during the fibrillation process, webs capable of entrapping particles of various sizes are possible. For instance, increasing the amount of lubricant to the point where it exceeds the lubricant sorptive capacity of the particulate by at least 3% (by weight) and up to 200% (by weight) can provide mean void sizes in the range of 0.3 μm to 5.0 μm with at least 90% of the voids having a size of less than 3.6 μm. This process can be used to create a web with one or more kinds of reactive particulate enmeshed therein. The PTFE which forms the web within which particulate is to be trapped can be obtained in resin emulsion form wherein the PTFE and lubricant are already pre-mixed (e.g., Teflon TM 30 or 30B, DuPont de Nemours; Wilmington, Del.). To this emulsion can be added additional lubricant in the form of water, water-based solvents such as a water-alcohol solution, or easily-removable organic solvents such as ketones, esters, and ethers, to obtain the aforementioned desired proportion of lubricant and particulate.

B. Non-PTFE Webs

In other embodiments of the article of the present invention, the fibrous web can comprise non-woven, polymeric macro- or microfibers preferably selected from the group of polymers consisting of polyamide, polyolefin, polyester, polyurethane, polyvinylhalide, or a combination thereof. (If a combination of polymers is used, a bicomponent fiber is obtained.) If polyvinylhalide is used, it preferably comprises fluorine of at most 75% (by weight) and more preferably of at most 65% (by weight). Addition of a surfactant to such webs may be desirable to increase the wettability of the component fibers.

1. Macrofibers

The web can comprise thermoplastic, melt-extruded, large-diameter fibers which have been mechanically-calendered, air-laid, or spunbonded. These fibers have average diameters in the general range of 50 μm to 1000 μm.

Such non-woven webs with large-diameter fibers can be prepared by a spunbond process which is well known in the art. (See, e.g., U.S. Pat. Nos. 3,338,992, 3,509,009, and 3,528,129, the fiber preparation processes of which are incorporated herein by reference.) As described in these references, a post-fiber spinning web-consolidation step (i.e., calendering) is required to produce a self-supporting web. Spunbonded webs are commercially available from, for example, AMOCO, Inc. (Napierville, Ill.).

Non-woven webs made from large-diameter staple fibers can also be formed on carding or air-laid machines (such as a Rando-Webber TM, Model 12BS made by Curlator Corp., East Rochester, N.Y.), as is well known in the art. See, e.g., U.S. Pat. Nos. 4,437,271, 4,893,439, 5,030,496, and 5,082,720, the processes of which are incorporated herein by reference.

A binder is normally used to produce self-supporting webs prepared by the air-laying and carding processes and is optional where the spunbond process is used. Such binders can take the form of resin systems which are applied after web formation or of binder fibers which are incorporated into the web during the air laying process. Examples of such resin systems include phenolic resins and polyurethanes. Examples of common binder fibers include adhesive-only type fibers such as Kodel TM 43UD (Eastman Chemical Products; Kingsport, Tenn.) and bicomponent fibers, which are available in either side-by-side form (e.g., Chisso TM ES Fibers, Chisso Corp., Osaka, Japan) or sheath-core form (e.g., Melty TM Fiber Type 4080, Unitika Ltd., Osaka, Japan). Application of heat and/or radiation to the web "cures" either type of binder system and consolidates the web.

Generally speaking, non-woven webs comprising macrofibers have relatively large voids. Therefore, such webs have low capture efficiency of small-diameter particulate which is introduced into the web. Nevertheless, particulate can be incorporated into the non-woven webs by at least four means. First, where relatively large particulate is to be used, it can be added directly to the web, which is then calendered to actually enmesh the particulate in the web (much like the PTFE webs described previously). Second, particulate can be incorporated into the primary binder system (discussed above) which is applied to the non-woven web. Curing of this binder adhesively attaches the particulate to the web. Third, a secondary binder system can be introduced into the web. Once the particulate is added to the web, the secondary binder is cured (independent of the primary system) to adhesively incorporate the particulate into the web. Fourth, where a binder fiber has been introduced into the web during the air laying or carding process, such a fiber can be heated above its softening temperature. This adhesively captures particulate which is introduced into the web. Of these methods involving non-PTFE macrofibers, those using a binder system are generally the most effective in capturing particulate. Adhesive levels which will promote point contact adhesion are preferred.

Once the particulate has been added, the particle-loaded webs are typically further consolidated by, for example, a calendering process. This further enmeshes the particulate within the web structure.

Webs comprising larger diameter fibers (i.e., fibers which average diameters between 50 μm and 1000 μm) have relatively high flow rates because they have a relatively large mean void size.

2. Microfibers

When the fibrous web comprises non-woven microfibers, those microfibers provide thermoplastic, melt-blown polymeric materials having active particulate dispersed therein. Preferred polymeric materials include such polyolefins as polypropylene and polyethylene, preferably further comprising a surfactant, as described in, for example, U.S. Pat. No. 4,933,229, the process of which is incorporated herein by reference. Alternatively, surfactant can be applied to a blown microfibrous (BMF) web subsequent to web formation. Particulate can be incorporated into BMF webs as described in U.S. Pat. No. 3,971,373, the process of which is incorporated herein by reference.

Microfibrous webs of the present invention have average fiber diameters up to 50 μm, preferably from 2 μm to 25 μm, and most preferably from 3 μm to 10 μm. Because the void sizes in such webs range from 0.1 μm to 10 μm, preferably from 0.5 μm to 5 μm, flow through these webs is not as great as is flow through the macrofibrous webs described above.

3. Microfibrillar

The web can also comprise a microfibrillar structure generated by the phase separation of a polymer/diluent solution. Preferred polymeric materials include such thermoplastic polyolefins as polypropylene and polyethylene. A preferred diluent is mineral oil.

Use of these materials to form such a microfibrillar material is described in, for example, U.S. Pat. No. 4,539,256. That reference discloses a microporous sheet material characterized by a multiplicity of spaced, randomly dispersed, equiaxed, non-uniformily shaped particles of the thermoplastic polymer.

Sheet materials are prepared by (1) melt blending a crystallizable thermoplastic polymer with a compound which is miscible with the thermoplastic polymer at the polymer's melting temperature but which phase separates upon cooling at or below the polymer's crystallization temperature; (2) forming the melt blend into a shaped article; and (3) causing the thermoplastic polymer and the miscible compound to phase separate by cooling the shaped article to a temperature at which the polymer crystallizes.

Particulate can be incorporated into these microfibrillar webs during the initial melt blending step according to the procedure described in U.S. Pat. No. 5,130,342, wherein the crystallizable thermoplastic polymer is melt blended with a dispersion of the desired particulate in the above-described diluent. Preferably, the diluent is removed from the phase separated web after cooling by extraction with a solvent which is miscible with the diluent but which is not miscible with the thermoplastic polymer or the particulate. This extraction results in a microporous, particle-loaded, thermoplastic polymer web which is practically diluent-free, wherein the particulate is non-agglomerated.

Microfibrillar webs of the present invention have average fibril diameters of more than zero up to 3 μm, preferably from 0.01 μm to 2 μm, and most preferably from 0.1 μm to 1 μm. The void sizes in these webs range from 0.01 μm to 4 μm, preferably from 0.1 μm to 2 μm, and their void volumes range from 50% to 90%, preferably from 60% to 80%. If increased void size and porosity is desired, stretching in the plane of the web can be performed. Because of the relatively small void sizes and volumes, the flow rates of these webs are somewhat less than the microfibrous webs previously described.

Because the preferred thermoplastic polymeric materials which define these webs are usually hydrophobic and because the void sizes of these webs are of a size where capillary forces dominate the penetration of a liquid into the voids, the surfaces of the microfibrillar structure are preferably treated so as to make them hydrophilic. An example of such a treatment is the coating of the microfibrils with a surfactant as described in U.S. Pat. No. 4,501,793. Although surfactants can be extracted by water and many other solvents, the voids of the web will remain filled with water once initial wetting of the web (in the marine environment) occurs. Therefore, the temporary nature of the described surfactant treatment is not a detriment.

II. Particulate

Active particulate useful in the present invention includes any antifouling and anticorrosive materials which can be immobilized in a non-woven, fibrous matrix. Particles of all shapes can be used in such a matrix. Average diameters of particles useful when the matrix comprises PTFE fibrils are within the range of 0.1 μm to 100 μm, more preferably within the range of 0.1 μm to 50 μm, and most preferably within the range of 1 μm to 10 μm. When the matrix of the sheet article comprises non-woven fibers of a polymer other than PTFE, the average diameters of the particles are within the range of approximately 0.1 μm to 600 μm, preferably within the range of 5 μm to 200 μm. It has been found that, where the web comprises macrofibers, larger particles are better retained. Such particulate can be incorporated directly into the membrane.

Where fouling protection is desired, particulate which is toxic to marine organisms will be entrapped in the web. Particularly effective biotoxins include those species of copper in solid form which are capable of producing aqueous copper ions, such as oxides of copper and copper particles. Where the aqueous environment in which the article is to be used is at least slightly acidic, a particularly useful species of copper is copper iodide. Not only are copper ions released as biotoxin, but iodine (another biotoxin) is also formed. Other useful metals and metal salts which have antifouling properties can also be so incorporated. Representative examples include organotin compounds and zinc salts.

Anticorrosive agents in forms which can be incorporated into the sheet article can be used to produce an anticorrosion layer. Representative examples include encapsulated sodium nitrite, certain amines, and combinations of a metal whose oxidation potential is greater than that of iron and a salt of that metal comprising said metal and an appropriate anion (such as zinc/zinc chromate).

Some forms of particulate can be incorporated as encapsulated reactant. For instance, antibiotics such as oxytetracycline can be encapsulated in polyurea. These capsules are either semipermeable or manufactured in such a way so as to have a time release effect. Antibiotics may also be incorporated into a polymeric binder matrix. This matrix system preferably produces a time release effect, also. Active particulate can also be bound to inert particles (i.e., coatings on solid supports). For example, enzymes which interfere with the ability of marine organisms to attach to marine substrates (e.g., by weakening or killing the organisms) can be covalently bonded to polyazlactone supports such as beads. Another form of incorporation is the entrapping of viable cells which produce enzymes with antifouling properties, such as *Aspergillus niger* and *Bacillus subtilis*, in the sheet article. This method of incorporation provides fouling protection of potentially unlimited duration.

Particulate is generally distributed uniformly in the web, but matrices which include combinations of particulate can be prepared. Alternatively, layers containing different particulate can be calendered into a single matrix with distinct strata of particulate. Such multilayer composites show minimal boundary mixing (between the various particulate) and retain good uniformity throughout each layer. Whether in a heterogeneous or homogenous form, this type of article can assure protection against fouling from diverse forms of marine life, protection against corrosion, or both.

Pigment and adjuvant particles with average diameters in the same ranges as listed previously with respect to active particulate can be included. Representative examples of useful pigments include carbon, copper phthalocyanine, taconite, zinc oxide, titanium dioxide, and ferric oxide. Such pigment particles can be included as part of an otherwise reactive layer or as a separate layer which is then calendered with reactive layers to form a multilayer composite. Other adjuvants which can be incorporated in the composite marine structure of the invention include silica, diffusion modifiers, bioactivity intensifiers, and ultraviolet radiation blockers. When present, such non-active particulate can comprise from more than 0% to 95% (by weight), preferably from more than 0% to 50% (by weight), and most preferably from more than 0% to 15% (by weight) of the sheet article.

The sheet article of the present invention preferably comprises active particulate in an amount of at least 10% (by weight), more preferably comprises active particulate in an amount of at least 50% (by weight), and most preferably comprises active particulate in an amount of at least 80% (by weight). The sheet article can comprise particulate in an amount up to 97% (by weight), (although particulate amounts in the range of 90–95% (by weight) tend to produce more stable webs). High active particulate loading is desirable to extend the useful life of the substrate. The particulate material can be of regular (flat, spherical, cubic, etc.) or irregular shape. The enmeshing fibrils or the fibrous web retain the enmeshed particulate, by entrapment or adhesion, within the matrix, and the enmeshed particles resist sloughing.

Once a sheet article with the desired properties is obtained, a water-resistant adhesive layer can be attached so that the article will adhere to the marine substrate to be protected. If the composite article of the marine structure comprises an anticorrosive stratum, the anticorrosive stratum is preferably adhered directly to the marine substrate so that the anticorrosive particulate will be as close as possible to the surface to be protected. Additionally, anticorrosive particulate can be dispersed in the adhesive layer itself so that maximum contact will be obtained. If pigment has been included has been included as a separate stratum of particulate, that stratum (which is also water-permeable) will necessarily be on the side opposite of the adhered surface.

In another aspect, the present invention provides a composite article comprising the water-permeable article of the above-described composite marine structure with a dual-sided tape attached to at least a portion of a surface thereof. This composite article can then be attached directly to the marine substrate to be protected.

In another aspect, the present invention provides a composite article comprising a non-woven web with active particulate enmeshed therein having a liner attached to at least one surface of the web. The liner can be attached to either side, or both sides, of the article. Where an adhesive has been attached to one side of the web, a differential release liner can be attached to the adhesive. This release liner can preferentially be peeled away from the adhesive, leaving the adhesive attached to the sheet article which can then be adhered to at least a portion of the marine substrate to be protected. Alternatively, a liner could be attached to that surface of the article which is not intended to be attached (either mechanically or by means of a water-soluble adhesive) to the marine substrate in order to provide said surface with protection from damage during handling or storage. In use, such a liner and attaching adhesive, if any is present, is removed from the sheet article.

In another aspect, the present invention provides a method of interfering with or inhibiting at least one of (1) accumulation of marine growth, and (2) corrosion of a marine substrate, the method comprising the step of allowing fresh or sea water to come into contact with a composite sheet article which is attached to a marine substrate, the composite sheet article comprising a porous, non-woven, fibrous web with active particulate enmeshed therein, the active particulate providing at least one of fouling or corrosion protection to the marine substrate.

The composite sheet article of the present invention can provide both fouling and corrosion protection to marine substrates of many shapes and sizes. The composite sheet article also can eliminate the need for a separate paint coating on the substrate since pigment particles of various hues can be incorporated in the sheet article.

Objects and advantages of this invention are further illustrated by the following examples, but the particular materials and amounts thereof, as well as other conditions and details, recited in these examples should not be construed to unduly limit this invention.

EXAMPLES

Example 1

This example describes the preparation of a copper particulate-loaded PTFE web using a commercial antifoulant paint pigment. The copper particles used were those included in VC17M TM boat bottom paint kits (International Paint, Inc.; Union, N.J.), which have a composition of 84.8% (by weight) copper and 15.2% (by weight) inert materials.

A 40.0 g portion of these copper particles was mixed with 11.76 g of Teflon TM 30B emulsion (60% solids) using a plastic beaker and a spatula. Two grams of ethanol were added to aid the wetting process, and a putty-like mixture was obtained after about 10 minutes of mixing with a spatula.

The gap of a rubber mill in its calendering mode was adjusted to 0.190 cm (75 mil). The roller temperature was set at 43.3° C. (110° F.). The putty-like mass was subjected to 15 initial passes that included three layer foldings and cross rotations between each pass.

The thick membrane produced by the 0.190 cm (75 mil) gap was subsequently made thinner by reducing the gap by 30% increments until the thickness of the web was about 0.01 cm (4.2 mils).

Example 2

This example describes a copper particulate-loaded, fibrillated PTFE web which was laminated with transfer tape to provide an article which was then adhered to a substrate to prevent biofouling.

A mixture of 56 g of copper powder (Fisher Chemicals; Fair Lawn, N.J.), water (10 ml), and 10 ml Teflon TM 30B emulsion (with 60% solids by weight) was worked on a rubber mill in its shearing mode, as described previously, to produce a microporous, leather-like web which was 15.2 cm wide, 91.4 cm long, and 0.1 mm thick (6 in.×3 ft.×0.1 mm). Due to outstanding conformability and good physical integrity, this web could be intimately conformed to all irregular surfaces without tearing. The web was soaked in water for 2 days to remove the soap present in the Teflon TM 30B emulsion. The web was dried and laminated on one side with Scotch ® Adhesive Transfer Tape (3M; St. Paul, Minn.).

The low-stick backing of the transfer tape on this article was removed, and the article was attached to flat surfaces, such as stainless steel, glass or fiberglass composite plates.

The plates were immersed in fresh water environments, such as indoor fish tanks and outdoor ponds, and exposed to air and light over a period of several years. During this time, the treated surface remained clear of algae, whereas all other surfaces became covered with algae. The fish swimming in such environments showed no ill effects.

Example 3

A mixture of 10 g of copper oxide powder (Fisher Chemicals), with particle diameters in the range of 1 μm to 10 μm, and 1 ml of a Teflon TM 30B emulsion (with 60% solids) was milled on a rubber mill as described in Example 1 to produce a leather-like, microporous web. The film was washed, dried, and then laminated on one side with transfer tape. After removal of the low-adhesive paper backing, this construction was laminated to flat surfaces (stainless steel or glass plates). The laminate was immersed in fresh water environments (fish tanks, outside ponds) intermittently for 6 months over a period of 5 years. No evidence of algae growth was noted on the $Cu_2O$-PTFE surface, but unprotected comparative surfaces were covered with algae growth.

Example 4

To demonstrate that all enmeshed $Cu_2O$ particles were accessible to liquid and subject to slow leaching, two 1 cm×4 cm fibrillated PTFE sheets enmeshing $Cu_2O$ (90% by weight) were immersed in dilute aqueous $NH_4OH$ for about one week. During that time, all $Cu_2O$ dissolved from the sheet, leaving a white framework of enmeshing PTFE fibers completely free of all the previously enmeshed particles. This shows that all reactive particles are accessible to fluids. In paints, only those particles at the surface are accessible. Other trials using fluid containing indicator dye and PTFE composite membranes comprising chromatographic alumina showed that fluids flow through the membranes without channeling.

Example 5

To demonstrate that non-metallic particulate can be enmeshed in a polymeric web, the following components were mixed:

- 1.4 g polyurea capsules (3M Encapsulation Technology Center; St. Paul, Minn.) containing 3% oxytetracycline (Sigma Chemical Co.; St. Louis, Mo.)
- 1.9 g polyazlactone beads* containing alcalase (Novo Laboratories; Danbury, Conn.)
- 1.5 g polyazlactone beads* containing protease (Novo Labs)
- 2.4 g polyazlactone beads* containing β-amylase (Novo Labs)
- 2.0 g water
- 3.0 g Teflon TM 30B aqueous emulsion (60% solids)

*As described in U.S. Pat. No. 4,737,560 (beads having a diameter of approximately 10 μm)

Additional water (3.0 g) was added to this mixture in order to form a dough. This putty-like mass was processed according to the procedure of Example 1 with 11 initial passes in a two-roll mill with a gap of 0.25 cm (100 mil). This produced a membrane with a thickness of 1.75 mm. Additional passes compressed the web to a final thickness of 0.5 mm.

Example 6

To demonstrate that a commercially-available metallic paint pigment can be incorporated into a fibrillated PTFE web, the following were mixed:

30.0 g MD 4760 TM copper shade pigment (M. D. Both Inc.; Ashland Mass.)
9.0 g Teflon TM 30B aqueous emulsion (60% solids)
2.5 g water Although the resulting putty-like mass was quite liquid, it was processed according to the procedure of Example 1 with numerous passes through a two-roll mill into a 0.025 cm (10 mil) web.

The webs described in Examples 7 and 8 were prepared to show the feasibility of incorporating low-cost fillers into a web.

Example 7

A membrane with the following components was prepared as follows:

200.0 g MD 4760 TM copper shade pigment
200.0 g Davisil TM TLC-grade silica (Davison Chemical; Baltimore, Md.)
117.6 g DuPont Teflon TM 30B emulsion (60% solids by wt.)
560.0 g 50:50 isopropanol/water mixture Using the procedure of Example 1, this putty-like mass was calendered down to a finishing gap of 0.46 mm (18 mil).

Example 8

A membrane with the following components was prepared as follows:

200 g VC17M TM copper particles (as described in Example 1)
200 g Davisil TM TLC-grade silica
117.6 g Teflon TM 30B emulsion (60% solids by wt.)
419 g 50:50 isopropanol/water mixture Using the procedure of Example 1, this putty-like mass formed a web after eight initial passes. The web was thinned to a finishing gap of 0.03 cm (12 mil).

Example 9

A membrane with the following components was prepared as follows:

200 g Purple Copp TM 97N cuprous oxide, 99.5% 325 mesh particles (American Chemet; Deerfield, Ill.)
37 g Teflon TM 30B emulsion (60% solids by wt.)

Using the procedure of Example 1, the membrane which formed from the putty-like mass was calendered to a thickness of 0.25 mm (10 mil).

The webs described in Examples 5–9 were backed with Scotch ® Hi Strength TM adhesive (3M; St. Paul, Minn.) and attached to 22.9 cm×12.7 cm (5 in.×9 in.) gel-coated fiberglass test panels. No fouling occurred on the copper-filled membranes after six months static immersion off the coast of Miami, Fla. Some fouling occurred on the web filled with the enzyme and antibiotic particles. No enzyme or antibiotic activity was detected in the web after the six months of immersion.

Example 10

A membrane with the following components was prepared as follows:

1200 g Purple Copp TM 97N cuprous oxide, 99.5% 325 mesh particles
222 g Teflon TM 30B emulsion (60% solids by wt.)

After calendering according to the procedure of Example 1, the membrane thickness was 0.25–0.30 mm (10–12 mil). After being immersed in the ocean for fifteen months, this membrane showed slight biofouling, which was easily removed by brushing. The copper color was readily restored by hand polishing with a SCOTCHBRITE TM scour pad (3M; St. Paul, Minn.).

A membrane covering a section of a racing yacht rudder remained adhered during seven and one half months of operation.

Example 11

The samples described herein show the feasibility of a microfibrillar polymer matrix. These samples can be characterized as Sample 1 Unfilled polyethylene web
Samples 2–3 Copper oxide in an expanded polyethylene web
Samples 4–5 Copper oxide in a surfactant-treated expanded polyethylene web Sample 1 was prepared according to Example 1 of World Patent No. 92/07899. Samples 2–5 were prepared according to Example 7 of U.S. Pat. No. 4,957,943, except that copper oxide particles with an average diameter of 0.5 μm (Charles B. Edwards & Co.; Minneapolis, Minn.) were dispersed in a mineral oil diluent at a loading adjusted to give a net copper content (relative to the weight of polyethylene) of 16.2% (by weight) in the finished membrane. Samples 4 and 5 were coated with Tween 21 TM (ICI Americas Co.; Wilmington, Mass.), a nonionic surfactant, according to the procedure described in Example 2 of U.S. Pat. No. 4,501,793. The samples were adhered to fiberglass test panels. The panels were immersed in sea water for six months. Sample 1 displayed no antifouling activity. Although samples 2–3 contained biotoxin, they displayed no antifouling activity, likely because the webs were hydrophilic. Samples 4 and 5 showed a dramatic increase in activity (i.e., fouling protection), although a few barnacles and some algae had attached.

Example 12

This example shows the feasibility of webs comprising non-PTFE polymeric fibers.

On several layers of RFX TM spunbond polypropylene web (AMOCO, Inc.; Hazelhurst, Ga.) was poured a generous amount of Purple Copp TM 97N (American Chemet) cuprous oxide, 99.5% 325 mesh particles. These layers were shaken until visual inspection showed that a large portion of the copper particles had become entrapped in the voids of the web. Ten of these layers were calendered into a loose web, and five other layers were calendered into another. These loose webs and a ten-layer comparative sample containing no copper were then pressed between the heated (approximately 400° F.) stainless steel plates of a Sentinel Press 808 (Packaging Industries Group; Hyannis, Mass.) for a few seconds until unitary webs were formed. The ten-layer web was 74% (by weight) copper, and the five-layer web was 76% (by weight) copper.

A 50 cubic centimeter Gurley TM Densometer Model 4110 (W. & L.E. Gurley Company; Troy, N.Y.) was used to test how tightly the webs were pressed together. The results of those tests were as follows:

Comparative web: 27.2 sec
10-layer web: 11.9 sec
5-layer web: 0.1 sec

Thus, although this process produces unitary copper-containing nonwoven webs (i.e., not subject to easy delamination), the resultant webs are sufficiently porous to allow for free fluid flow.

Various modifications and alterations which do not depart from the scope and spirit of this invention will become apparent to those skilled in the art. This invention is not to be unduly limited to the illustrative embodiments set forth herein.

We claim:

1. A composite marine structure comprising a marine substrate having adhered to at least a portion of its surface a layer of a water-permeable composite article comprising a non-woven fibrous web having entrapped therein particulate which is active toward at least one of marine fouling and corrosion, said article providing said marine structure with protection against at least one of fouling and corrosion.

2. The composite marine structure according to claim 1 wherein said composite article comprises active particulate in the range of 10% to 97% (by weight) of the article.

3. The composite marine structure according to claim 1 wherein said composite article comprises active particulate in the range of 50% to 95% (by weight) of the article.

4. The composite marine structure according to claim 1 wherein said composite article comprises active particulate in the range of 80% to 90% (by weight) of the article.

5. The composite marine structure according to claim 1 wherein said active particulate is toxic to marine organisms.

6. The composite marine structure according to claim 5 wherein said active particulate is at least one compound capable of producing aqueous copper ions.

7. The composite marine structure according to claim 6 wherein said active particulate is at least one of the oxides of copper.

8. The composite marine structure according to claim 5 wherein said active particulate is an antibiotic.

9. The composite marine structure according to claim 8 wherein said antibiotic is selected from the group consisting of antibiotic coatings on solid supports, antibiotic capsules with time release properties, and antibiotic incorporated in a time release binder matrix.

10. The composite marine structure according to claim 5 wherein said active particulate is an enzyme with biotoxic properties.

11. The composite marine structure according to claim 5 wherein said active particulate are cells which produce enzymes with biotoxic properties.

12. The composite marine structure according to claim 1 wherein said active particulate is a combination of a metal whose oxidation potential is greater than that of iron and a metal salt comprising said metal and an appropriate anion.

13. The composite marine structure according to claim 12 wherein said metal/metal salt combination is zinc/zinc chromate.

14. The composite marine structure according to claim 1 wherein said web is fibrillated polytetrafluoroethylene.

15. The composite marine structure according to claim 1 wherein said web is selected from the group consisting of polyamide, polyolefin, polyester, polyurethane, and polyvinylhalide.

16. The composite marine structure according to claim 15 wherein said web comprises bicomponent fibers.

17. The composite marine structure according to claim 15 wherein said web is prepared by at least one method selected from the group consisting of calendering, air-laying, spunbonding, and phase-separation processes.

18. The composite article according to claim 1 wherein said particulate is a combination of different particulate.

19. The composite article according to claim 18 wherein said different particulate are in distinct strata in said web.

20. A composite marine article comprising (a) a non-woven fibrous web, (b) particulate, which is active toward at least one of marine fouling and corrosion, entrapped within said web, and (c) a dual-sided tape attached to at least a portion of one surface of said web.

21. A composite marine article comprising (a) a non-woven fibrous web, (b) particulate, which is active toward at least one of marine fouling and corrosion, entrapped within said web, and (c) a liner attached to at least a portion of one surface of said web.

22. The composite marine article according to claim 20 wherein said web is polytetrafluoroethylene.

23. The composite marine article of claim 20 further comprising a liner attached to at least a portion of said dual-sided tape.

24. A method of interfering with at least one of 1) accumulation of marine growth on, and 2) corrosion of a marine structure comprising the step of allowing fresh or sea water to come into contact with a composite sheet article which is attached to a marine substrate, said composite sheet article comprising a porous, nonwoven, fibrous web with active particulate entrapped therein, said active particulate providing at least one of fouling and corrosion protection to said marine structure.

* * * * *